US005255486A

United States Patent [19]

Wang

[11] Patent Number: 5,255,486

[45] Date of Patent: Oct. 26, 1993

[54] LOUVER DOOR CONSTRUCTION

[75] Inventor: David Wang, Kaohsiung Hsien, Taiwan

[73] Assignee: Eli Plastics Industrial Co., Ltd., Tainan Hsien, Taiwan

[21] Appl. No.: 977,769

[22] Filed: Nov. 17, 1992

[51] Int. Cl.[5] ..... E05B 7/08

[52] U.S. Cl. ..... 52/473; 454/280

[58] Field of Search ..... 52/473; 454/277, 280, 454/281, 283

[56] References Cited

U.S. PATENT DOCUMENTS

| | | | |
|---|---|---|---|
| 2,820,407 | 1/1958 | Smith | 454/280 X |
| 3,068,536 | 12/1962 | Lieber | 52/473 X |
| 3,302,554 | 2/1967 | Rousey et al. | 454/280 |
| 3,797,186 | 3/1974 | Smith | 52/473 X |
| 5,060,442 | 10/1981 | Chubb | 52/473 |
| 5,120,273 | 6/1992 | Lin | 454/277 X |

FOREIGN PATENT DOCUMENTS

| | | | |
|---|---|---|---|
| 2042775 | 7/1971 | Fed. Rep. of Germany | 52/473 |

*Primary Examiner*—Philip C. Kannan
*Attorney, Agent, or Firm*—Ladas & Parry

[57] ABSTRACT

A louver door construction includes a spaced pair of vertical stiles and a louver unit which is formed as a one-piece extruded plastic sheet secured between the vertical stiles. The louver unit includes a plurality of integrally connected louver sections, each having an elongated inclined portion and an elongated horizontal portion. The inclined portions of the louver sections extend upwardly and rearwardly from front edges of the corresponding horizontal portions. The inclined portion of one louver section has a distal upper edge which is connected integrally with a rear edge of the horizontal portion of an adjacent louver section. The inclined portions of the louver sections are parallel with one another, while the horizontal portions of the louver sections are parallel with one another. The horizontal portions of some of the louver sections are formed with a series of slots which permit flow of air through the louver unit. Top and bottom rails are mounted on and extend between upper and lower ends of the vertical stiles.

5 Claims, 7 Drawing Sheets

LOUVER DOOR CONSTRUCTION

BACKGROUND OF THE INVENTION

1. Field of the Invention

The invention relates to a and a louver door construction which incorporates a louver unit, more particularly to a louver door construction with a louver unit which is easy to assemble and which can prevent insects from passing therethrough while permitting air flow through the same.

2. Description of the Related Art

FIG. 1 is an illustration of a convention louver door construction. The louver door construction can be made of wood or plastic and includes a pair of opposed vertical stiles (11). Each of the vertical stiles (11) is formed with a plurality of slanted recesses (13) on one side. Each of a plurality of slats (12) is retained between the vertical stiles (11) by inserting each end of the slats into one of the slanted recesses (13) of the latter, thus forming the louver door.

The slats (12) are slanted so as to prevent someone standing on one side of the louver door from seeing what is on the other side of the louver door. A gap (14) is formed between two adjacent slats (12) so as to enable light and air to pass through the louver door.

The main drawbacks of the conventional louver door construction are as follows:

1. The conventional louver door construction cannot be assembled easily since the ends of the slats (12) have to be inserted one by one into the slanted recesses (13) of the vertical stiles (11).

2. Insects can easily pass through the louver door since the gap (14) which is formed between two adjacent slats (12) is relatively large.

3. The louver door cannot effectively prevent someone standing on one side of the louver door from seeing what is on the other side of the louver door since the size of the gap (14) is relatively large.

SUMMARY OF THE INVENTION

Therefore, the objective of the present invention is to provide an improved louver door construction which can overcome the drawbacks that are commonly associated with the prior art.

Accordingly, the louver door construction of the present invention comprises:

a spaced pair of vertical stiles;

a louver unit formed as a one-piece extruded plastic sheet and secured between the vertical stiles, said louver unit including a plurality of integrally connected louver sections, each of the louver sections having an elongated inclined portion and an elongated horizontal portion, said inclined portion of one of the louver sections extending upwardly and rearwardly from a front edge of the corresponding horizontal portion, said inclined portion of one of the louver sections having a distal upper edge which is connected integrally with a rear edge of the horizontal portion of an adjacent one of the louver sections, said inclined portion of one of the louver sections forming a first angle with the horizontal portion of the same section, said horizontal portion of one of the louver sections forming a second angle with the inclined portion of the adjacent one of the louver sections, said second angle being equal to the first angle, said inclined portions of the louver sections being parallel with one another, said horizontal portions of the louver sections being parallel with one another, said horizontal portion of some of the louver sections being formed with a series of slots which permit air flow through the louver unit; and top and bottom rails mounted on and extending between upper and lower ends of the vertical stiles.

BRIEF DESCRIPTION OF THE DRAWINGS

Other features and advantages of the present invention will become apparent in the following detailed description of the preferred embodiments, with reference to the accompanying drawings, of which.

DETAILED DESCRIPTION OF THE PREFERRED EMBODIMENTS

Figure 1:
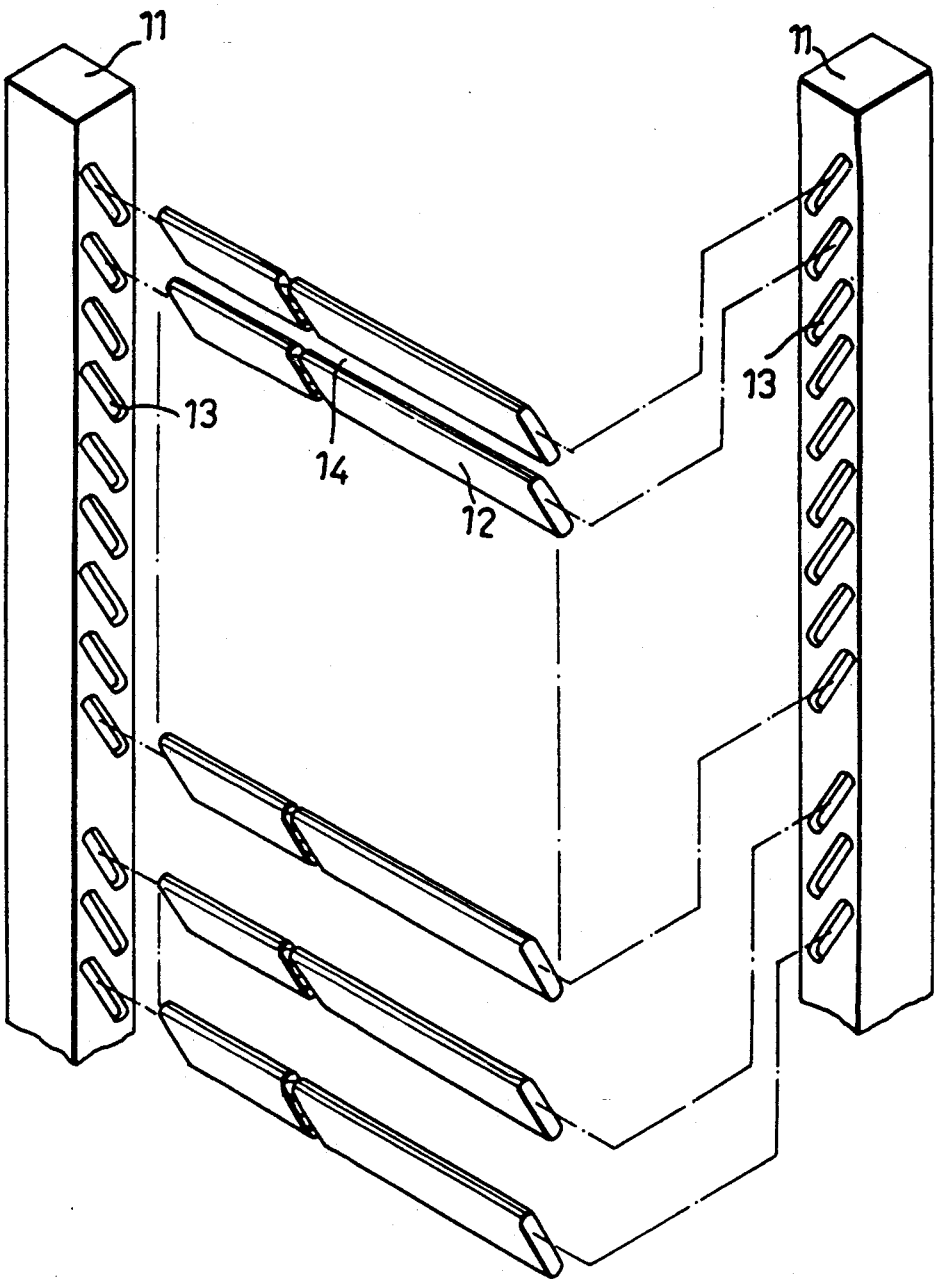
FIG.1 PRIOR ART
FIG. 1 is an exploded view of a conventional louver door construction.
Figure 2:
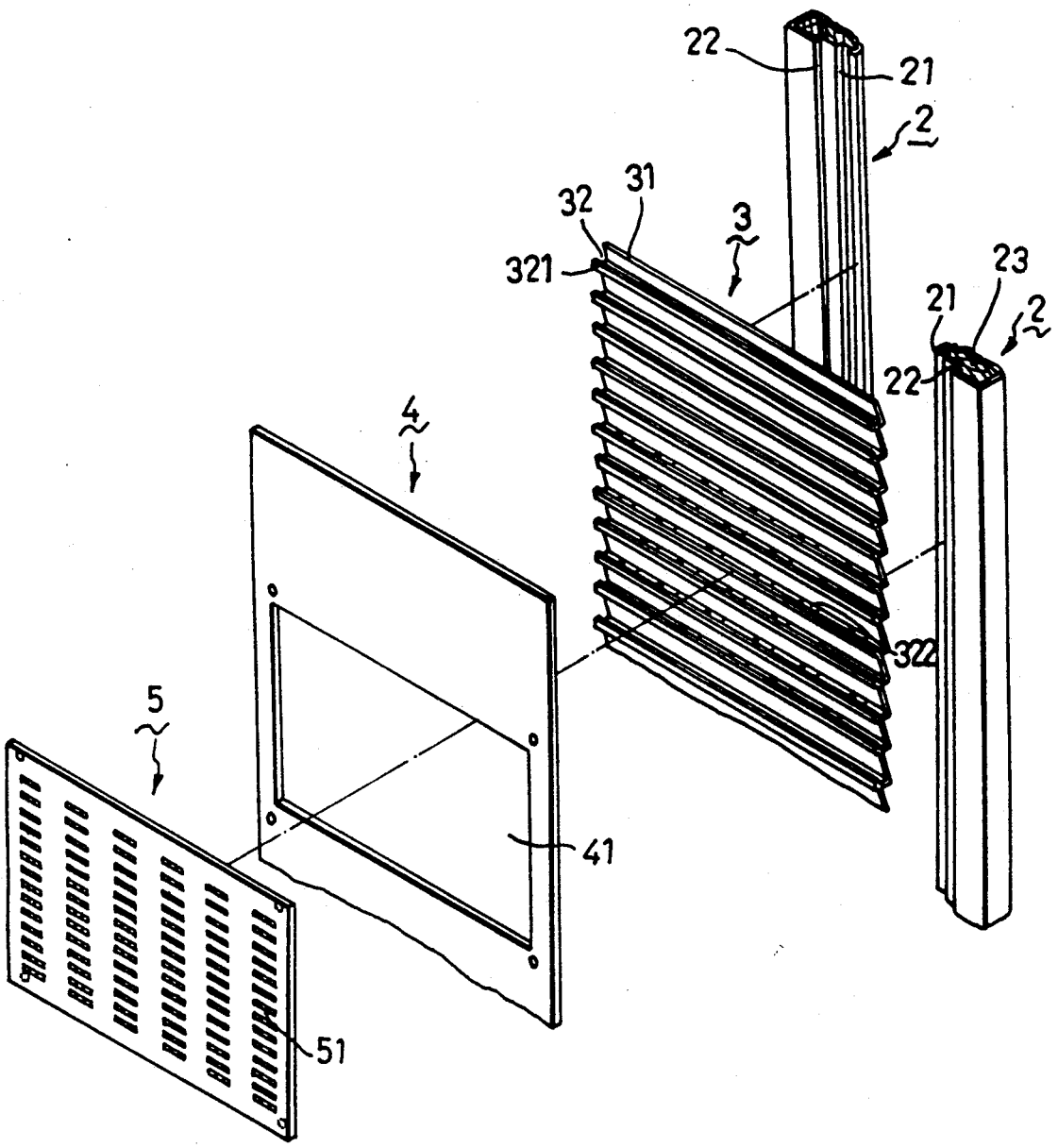
FIG. 2 is an exploded view of the first preferred embodiment of a louver door construction according to the present invention.

Referring to FIG. 2, the first preferred embodiment of a louver door construction according to the present invention comprises a pair of opposed vertical stiles (2), a louver unit (3), a back plate (4) and a grille (5).

Each of the vertical stiles (2) is a one-piece curved plate member which is made from extruded polyvinyl chloride (PVC) plastic. The rear side of each vertical stile (2) is formed with a vertically extending first groove (21) at a longitudinal edge of the stile. A vertically extending second groove (22) is also formed on the rear side of each vertical stile (2) and communicates with and is disposed adjacent to the first groove (21). The depth of the second groove (22) is shallower than that of the first groove (21). Each of the vertical stiles (2) is filled with a reinforcing material (23) so as to enhance its structural strength. The construction of the vertical stiles (2) is described in greater detail in a copending application by the Applicant.

Figure 3:
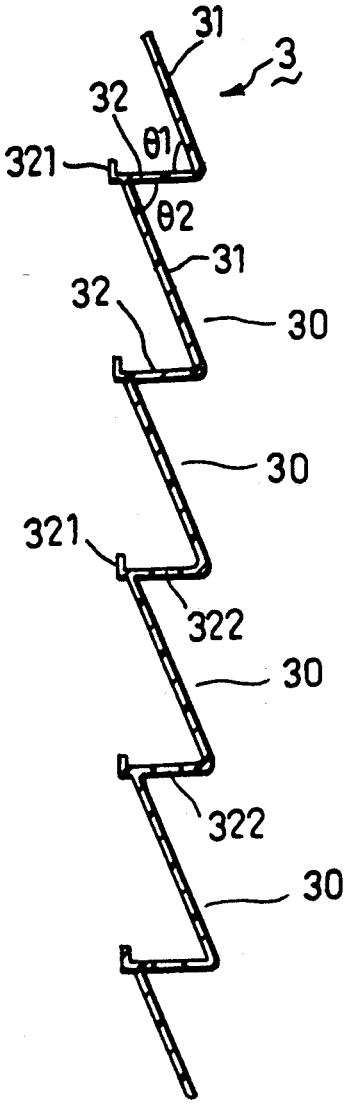
FIG. 3 is a sectional view of a louver unit of the first preferred embodiment.

Referring to FIG. 3, the louver unit (3) is a one-piece extruded PVC plastic sheet and is provided between the vertical stiles (2) such that vertical edges of the sheet extend into the first grooves (21) of the stiles. The louver unit (3) includes a plurality of integrally connected louver sections (30). Each of the louver sections (30) has an elongated inclined portion (31) and an elongated horizontal portion (32). The inclined portion (31) extends upwardly and rearwardly from a front edge of the horizontal portion (32). The rear edge of the horizontal portion (32) is formed with an upwardly extending reinforcing strip (321). The inclined portion (31) has a distal upper edge which is connected integrally with the rear edge of the horizontal portion (32) of an adjacent louver section (30). The inclined portion (31) of each louver section (30) forms a first angle ($\Theta 1$) with the horizontal portion (32) of the same section. The horizontal portion (32) of each louver section (30) forms a second angle ($\Theta 2$) with the inclined portion (31) of an adjacent one of the louver sections (30). The second angle (Θ2) is preferably equal to the first angle (Θ1). Therefore, the inclined portions (31) of the louver sections (30) are parallel with one another, while the horizontal portions (32) are similarly parallel with one another, thereby providing the louver unit (3) with a sawtoothed appearance. The horizontal portion (31) of intermediate ones of the louver sections (30) is formed with a series of rectangular slots (322) which permit air flow through the louver unit (3) while hindering the passage of insects therethrough.

Referring once more to FIG. 2, the back panel (4) is a PVC plate which has an area that is larger than that of the louver unit (3). The back panel (4) is provided between the vertical stiles (2) at the back of the louver unit (3) such that the vertical edges of the back panel (4) extend into the second grooves (22) of the vertical stiles (2). The back panel (4) abuts against the reinforcing strips (321) of the louver unit (3). The vertical edges of the back panel (4) are fixed in the second grooves (22) of the vertical stiles (2) by means of adhesives or screws, thereby clamping the louver unit (3) against the vertical stiles (2). The back panel (4) is provided with an opening (41) which is aligned with the intermediate ones of the louver sections (30), thereby permitting the passage of air which enters via the rectangular slots (322).

The grille (5) is mounted on the rear side of the back panel (4) by means of adhesives or screws. The grille (5) covers the opening (41) of the back panel (4) and has an area which is larger than the opening (41). The grille (5) is formed with a plurality of through holes 51 which are smaller than the rectangular slots (322) of the louver sections (30).

Figure 4:
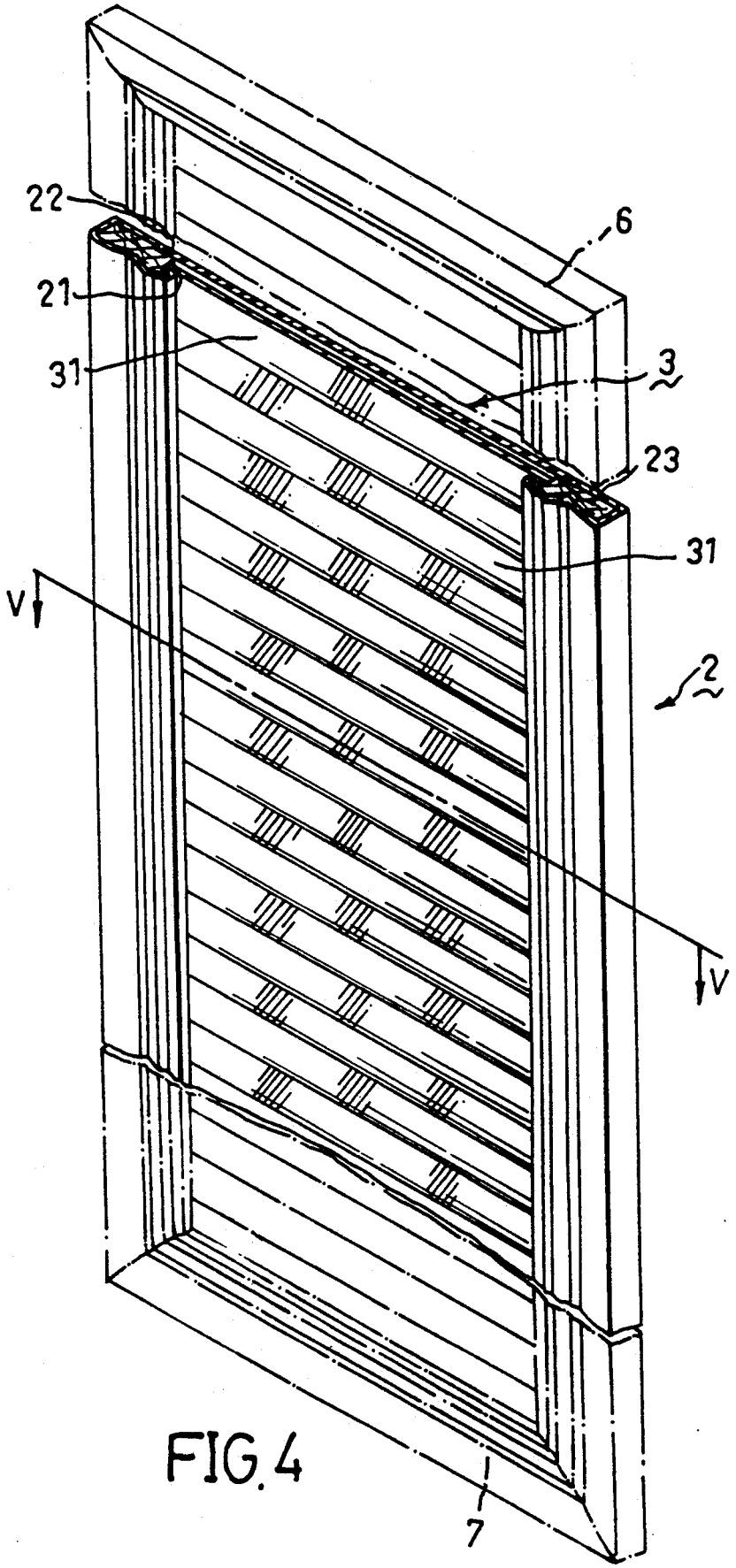
FIG. 4 is a front perspective view which illustrates the assembly of the first preferred embodiment.
Figure 5:
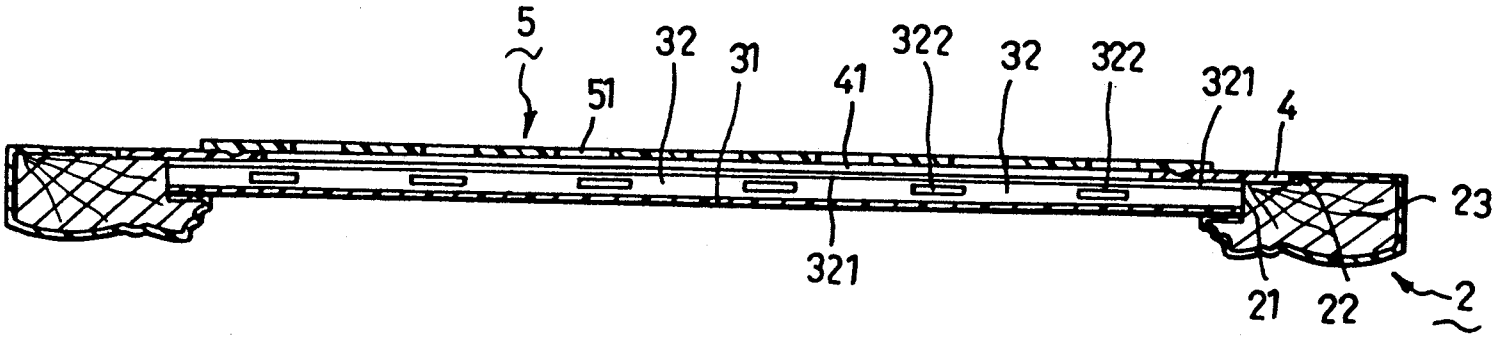
FIG. 5 is a sectional view taken along line V—V in FIG. 4.
Figure 6:
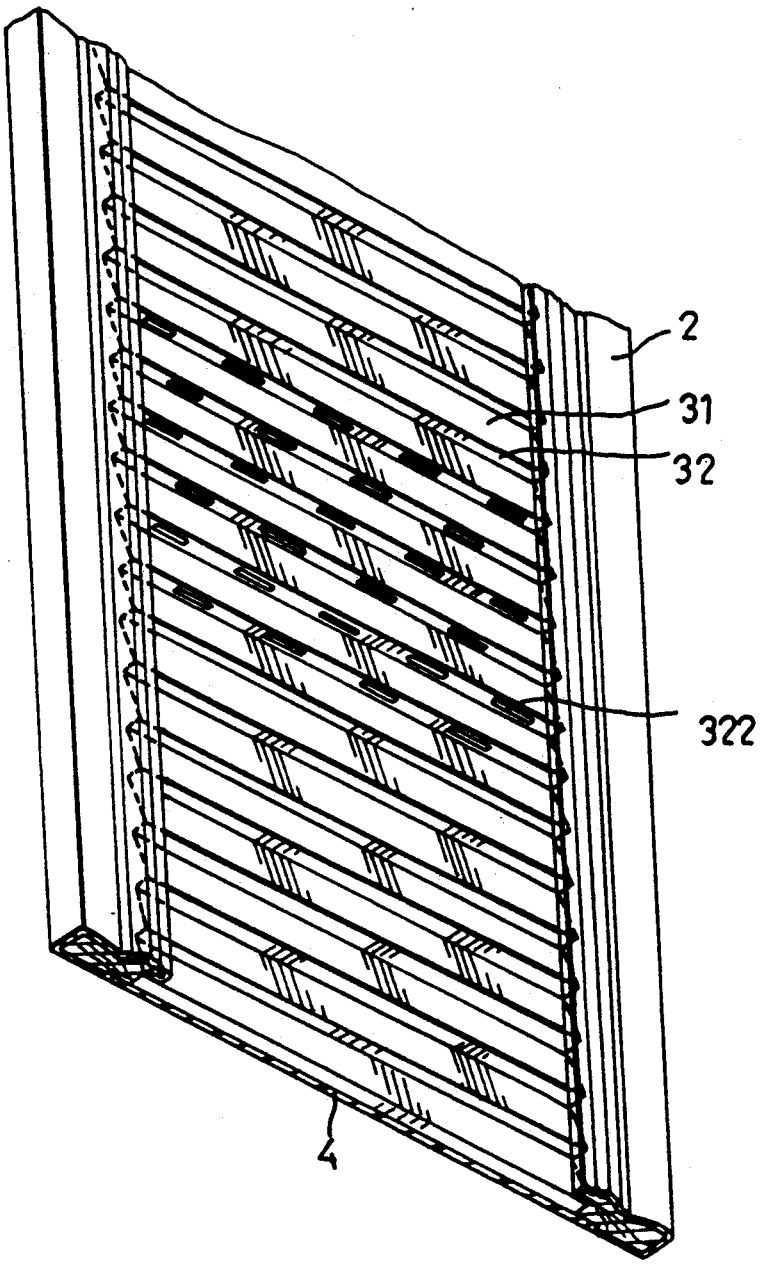
FIG. 6 is a rear perspective view of the first preferred embodiment.

FIGS. 4 to 6 illustrate the first preferred embodiment of a louver door construction according to the present invention when assembled. The louver unit (3) can effectively prevent someone standing on one side of the louver door from seeing what is on the other side of the louver door since the rectangular slots (322) are disposed horizontally and are smaller than the gaps (14) which are formed in the previously described conventional louver door construction. The thickness of the back panel (4) preferably corresponds to the depth of the second grooves (22) of the vertical stiles (2). The louver door construction further comprises top and bottom rails (6, 7) which are mounted on upper and lower ends of the vertical stiles (2) in a conventional manner.

Figure 7:
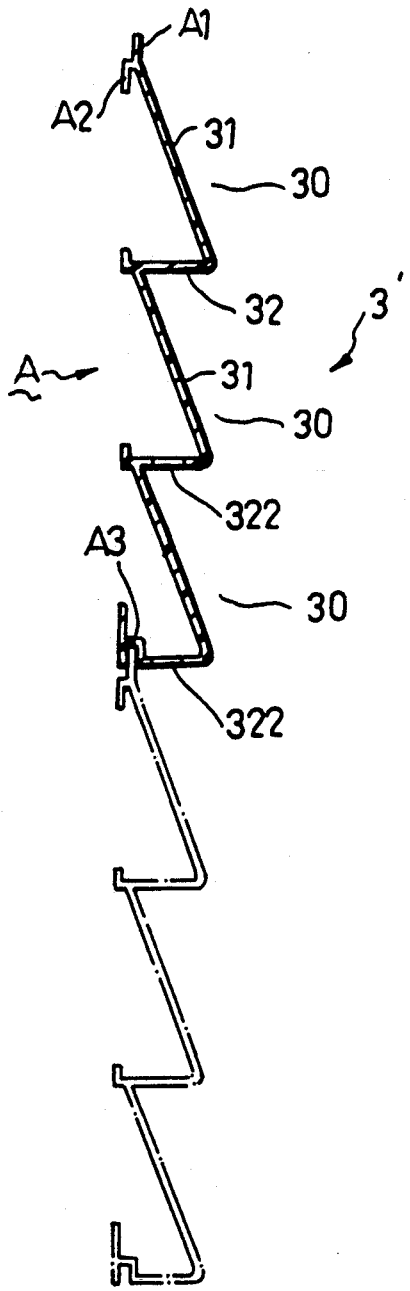
FIG. 7 is a sectional view of a louver unit of the second preferred embodiment of a louver door construction according to the present invention.

FIG. 7 illustrates a louver unit (3') of the second preferred embodiment of a louver door construction according to the present invention. The louver unit (3') includes two one-piece louver units (A). Each of the louver units (A) includes three interconnected louver sections (30). The inclined portion (31) of the louver section (30) on one end of each louver unit (A) is formed with an upwardly extending engaging strip (A1) and a downwardly extending reinforcing strip (A2). The horizontal portion (31) of the louver section (30) on the other end of each louver unit (A) is formed with a longitudinal retaining groove (A3) which is adjacent to the rear edge of the horizontal portion (31). The retaining groove (A3) of one of the louver units (A) receives the engaging strip (A1) of the other one of the louver units (A), thereby forming the louver unit (3'). The smaller size of the louver units (A) facilitates the manufacture their. Furthermore, a plurality of louver units (A) may be interconnected so as to form different lengths of louvers units (3').

The advantages and characterizing features of the louver door construction of the present invention are as follows:

1. The louver door construction can be easily assembled since the louver unit (3) is a one-piece member.

2. The louver unit (3, 3'), the back panel (4) and the grille (5) permit air flow through the louver door while preventing insects from passing therethrough.

3. The louver unit (3, 3') can effectively prevent someone standing on one side of the louver door from seeing what is on the other side of the louver door.

While the present invention has been described in connection with what is considered the most practical and preferred embodiments, it is understood that this invention is not limited to the disclosed embodiments but is intended to cover various arrangements included within the spirit and scope of the broadest interpretation so as to encompass all such modifications and equivalent arrangements.

I claim:

1. A louver door construction, comprising:

a spaced pair of vertical stiles;

a louver unit formed as a one-piece extruded plastic sheet and secured between said vertical stiles, said louver unit including a plurality of integrally connected louver sections, each of said louver sections having an elongated inclined portion and an elongated horizontal portion, said inclined portion of one of said louver sections extending upwardly and rearwardly from a front edge of said horizontal portion of said one of said louver sections, said inclined portion of said one of said louver sections having a distal upper edge which is connected integrally with a rear edge of said horizontal portion of an adjacent one of said louver sections, said inclined portion of said one of said louver sections forming a first angle with said horizontal portion of said one of said louver sections, said horizontal portion of said one of said louver sections forming a second angle with said inclined portion of said adjacent one of said louver sections, said second angle being equal to said first angle, said inclined portions of said louver sections being parallel with one another, said horizontal portions of said louver sections being parallel with one another, said horizontal portion of some of said louver sections being formed with a series of slots which permit air flow through said louver unit; and top and bottom rails mounted on and extending between upper and lower ends of said vertical stiles, each of said vertical stiles having a rear side which is formed with a vertically extending first groove at a longitudinal edge thereof, said louver unit having vertical edges which respectively extend into said first groove of said vertical stiles, said horizontal portion of each of said louver sections having a rear edge which is formed with an upwardly extending reinforcing strip.

2. The louver door construction as claimed in claim 1, wherein;

said rear side of each of said vertical stiles is further formed with a vertically extending second groove which communicates with and is adjacent to said first groove, said second groove having a depth which is shallower than that of said first groove; and said louver door construction further comprises a back panel secured between said vertical stiles behind said louver unit, said back panel having vertical edges which respectively extend into said second groove of said vertical stiles, said back panel abutting against said reinforcing strips of said louver unit, said back panel being provided with an opening which is aligned with said louver sections which are formed with said slots.

3. The louver door construction as claimed in claim 2, further comprising a grille which is mounted on a rear side of said back panel and which covers said opening of said back panel.

4. The louver door construction as claimed in claim 3, wherein said grille is formed with a plurality of through holes which are smaller than said slots of said louver sections.

5. The louver door construction as claimed in claim 2, wherein said back panel has a thickness which corresponds to said depth of said second groove of said vertical stiles.

* * * * *